United States Patent [19]

Sinn

[11] Patent Number: 4,775,777

[45] Date of Patent: Oct. 4, 1988

[54] OPEN-LOOP SELF-CLEANING OVEN TEMPERATURE CONTROL

[75] Inventor: Richard E. Sinn, St. Joseph Township, Berrien County, Mich.

[73] Assignee: Whirlpool Corporation, Benton Harbor, Mich.

[21] Appl. No.: 139,979

[22] Filed: Dec. 31, 1987

[51] Int. Cl.[4] ..... H05B 1/02

[52] U.S. Cl. ..... 219/397; 219/413; 219/494; 219/497; 219/492

[58] Field of Search ..... 219/397, 395, 396, 412, 219/413, 414, 497, 494, 398, 506, 492, 400, 10, 55 B; 374/1, 25, 102; 116/216, 292, 307

[56] References Cited

U.S. PATENT DOCUMENTS

| | | | |
|---|---|---|---|
| 3,924,101 | 12/1975 | Beard | 219/494 |
| 4,122,719 | 10/1978 | Carlson | 219/506 |
| 4,369,352 | 1/1983 | Bowles | 219/413 |
| 4,528,637 | 7/1985 | Smith | 374/1 |

*Primary Examiner*—E. A. Goldberg
*Assistant Examiner*—Teresa J. Walberg
*Attorney, Agent, or Firm*—Mason, Kolehmainen, Rathburn & Wyss

[57] ABSTRACT

A nominal closed-loop temperature control system and method for a self-cleaning oven is adapted, upon recalibration of the bake temperature of the oven, to operate in an open-loop manner during the CLEAN mode of operation of the oven, Specifically, prior to recalibration of the oven, an average value of the duty cycle of the oven heating elements used during a self-cleaning operation is measured and stored. Subsequently, upon a positive recalibration or increase in the nominal values of the bake temperatures of the oven, the duty cycle of the heating elements during a self-cleaning operation is slightly increased to increase the average value of the self-cleaning temperature of the oven. Correspondingly, upon a negative recalibration or decrease in the nominal values of the bake temperatures, the duty cycle of the heating elements during a self-cleaning operation is slightly decreased to decrease the average value of the self-cleaning temperature of the oven. For safety and performance reasons, any such temperature increase or decrease occurs in an open-loop manner by being limited to a value less than that capable of being detected by the closed-loop operation of the oven temperature control system.

17 Claims, 1 Drawing Sheet

OPEN-LOOP SELF-CLEANING OVEN TEMPERATURE CONTROL

BACKGROUND OF THE INVENTION

A. Field of the Invention

The present invention generally relates to temperature control systems and methods, and, more particularly, to a new and improved open-loop self-cleaning oven temperature control system and method.

B. Description of the Prior Art

Self cleaning ovens and temperature controls therefor are old and well known in the prior art as exemplified by U.S. Pat. Nos. 3,121,158; 3,122,626; 3,310,654; 3,327,094; 3,353,004; 3,569,670; 3,648,012; 3,738,174; 3,924,101; 4,166,268; 4,214,224; and 4,369,352. Conventionally, the bake temperature controls for many prior art self-cleaning ovens are capable of being recalibrated in service to compensate for oven components that deviate from design specifications or to accommodate individual user preferences. See, for example, the above-identified '670 patent and the '101 patent and the '352 patent. Some prior art temperature control systems for self-cleaning ovens are designed to maintain a constant clean temperature even though the bake temperatures have been recalibrated and offset by a predetermined amount from nominal values. Recalibration of the bake temperatures in other prior art systems necessarily affect the clean temperature.

With the advent of digital electronic microprocessor based control systems for controlling the temperature in self-cleaning ovens, specific operating characteristics are inherent in a particular design of the control system. For example, in a specific prior art electric range commercially made and sold by the assignee of the present invention, the digital electronic microprocessor based closed-loop control circuit for controlling the temperature of a self-cleaning oven of the range provides a much finer or greater level of temperature control resolution in the BAKE mode than in the CLEAN mode. Therefore, a particular self-cleaning oven that runs too hot or too cool due, for example, to a faulty oven temperature sensor, cannot easily have its clean temperature adjusted during recalibration of the bake temperatures. A need therefore exists to enable the clean temperature of a self-cleaning oven to be adjusted when the bake temperatures of the oven are recalibrated, while limiting the change produced in the clean temperature to a value smaller than that capable of being detected by the closed-loop temperature control system.

SUMMARY OF THE INVENTION

An object of the present invention is to provide a new and improved self-cleaning oven temperature control system and method.

Another object of the present invention is to provide a new and improved temperature control system and method for a self-cleaning oven in which the clean temperature may be adjusted and maintained in an open-loop manner after the bake temperatures of the oven have been recalibrated, the adjustment of the clean temperature being less than that capable of being detected by the nominal closed-loop operation of the control system.

Briefly, the present invention constitutes a new and improved digital electronic microprocessor based self-cleaning oven temperature control system and method. The temperature control system and method operate in a conventional closed-loop manner to control the amount of heat energy supplied to the oven by the electrically energized oven heating elements. In this manner, the oven is heated until the desired or preselected oven temperature is reached. Thereafter, energy to the heating elements may be removed until the oven temperature falls below a predetermined value, at which time energy is resupplied to the heating elements to maintain the temperature of the oven at the desired or preselected value. Because the one or more oven heating elements have fixed resistances that are energized by a constant voltage source of alternating current electrical power, the temperature of the oven is controlled by controlling the duty cycle of the heating elements, i.e., the percentage of time the heating elements are ON or energized during the operation of the oven.

In accordance with an important feature of the present invention, upon recalibration of the bake temperatures of the oven, the oven temperature control system and method are capable of operating in an open-loop manner during the CLEAN mode of operation of the oven to compensate for degradation in the performance of one or more oven components, such as a conventional oven temperature sensor. For example, if the bake temperatures have been increased during a recalibration operation, then during the CLEAN mode of operation of the oven, the heating elements of the oven are controlled in an openloop manner by slightly increasing their duty cycle, thereby increasing the average temperature of the oven during the CLEAN mode of operation. Correspondingly, if during a recalibration operation, the bake temperatures are decreased, then during the CLEAN mode of operation of the oven, the heating elements of the oven are controlled in an open-loop manner by slightly decreasing their duty cycle, thereby decreasing the average temperature of the oven during the CLEAN mode of operation. In either event, the temperature of the oven is continually sensed to ensure that the closed-loop nominal or rereference clean temperature is not exceeded in the positive or negative directions by more than the above-mentioned open-loop offset value. In this manner, the clean temperature may be adjusted in accordance with the recalibration of the bake temperatures and independently of the resolution of the microprocessor based closed-loop temperature control system and method.

BRIEF DESCRIPTION OF THE DRAWING

The above and other objects, advantages and novel features of the present invention will become apparent from the following detailed description of the preferred embodiment of the present invention illustrated in the accompanying drawing wherein.

DESCRIPTION OF THE PREFERRED EMBODIMENT

Figure 1:
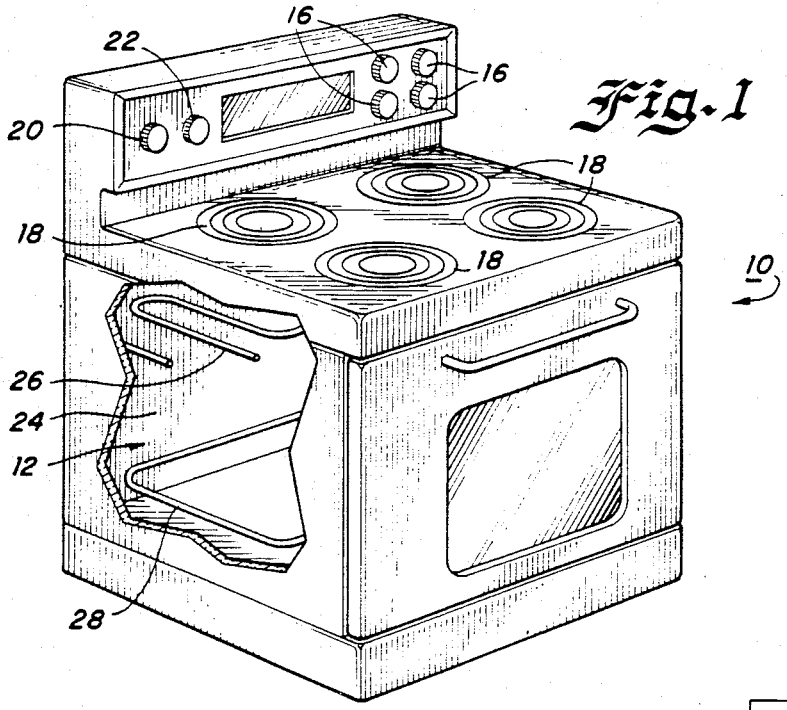
FIG. 1 illustrates a self-cleaning electric range having an oven adapted to be controlled by an oven temperature control system and m ethod constructed in accordance with the principles of the present invention.
Figure 2:
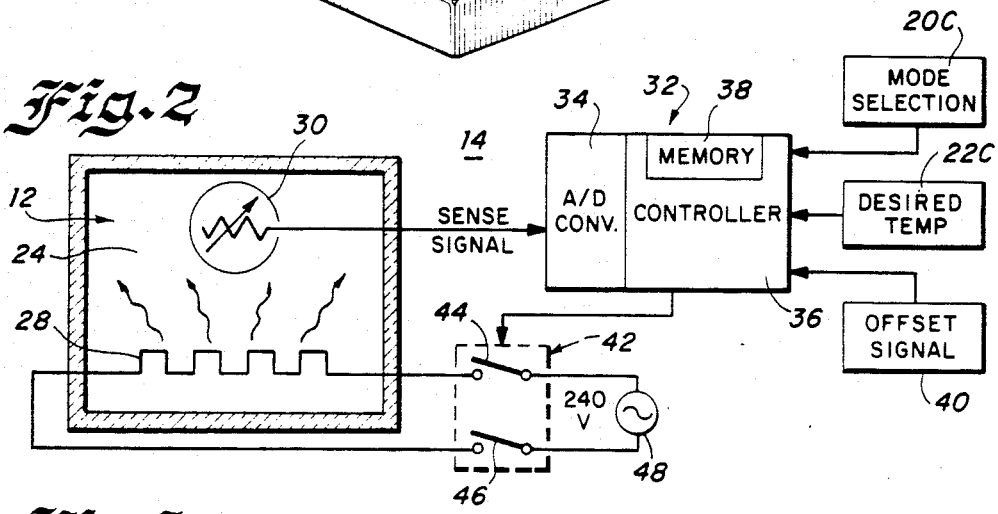
FIG. 2 is a schematic view of a digital electronic microprocessor based oven temperature control system designed to be operated in accordance with the principles of the present invention.
Figure 3:
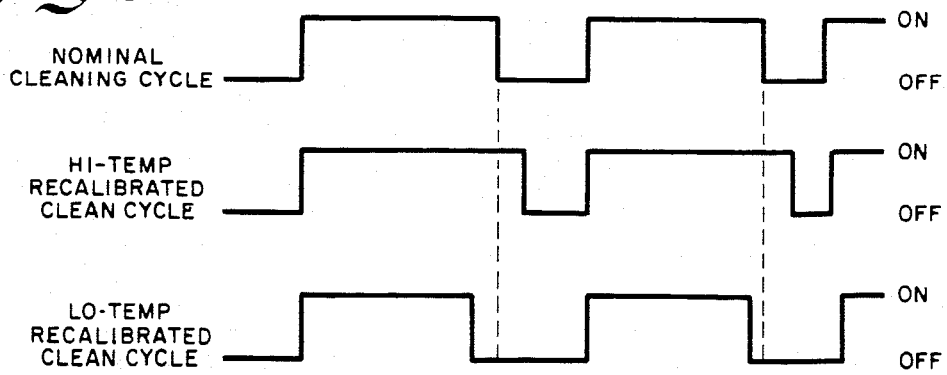
FIG. 3 illustrates timing charts depicting the duty cycles associated with the operation of the heating elements of an oven in accordance with the principles of the present invention.

Referring to the drawing and specifically to FIGS. 1-3 thereof, therein is illustrated an electric range 10 having a self-cleaning oven 12 adapted to be controlled by a new and improved digital electronic microprocessor based control system 14 and method in accordance with the principles of the present invention. The range 10 includes a plurality of four control knobs 16 for respectively controlling a plurality of four conventional electric burners 18. In addition, the range 10 includes a control knob 20 for controlling the mode of operation of the oven 12, for example, the OFF mode, the BAKE mode, the BROIL mode and the CLEAN mode of operation. In addition, the range 10 includes a control knob 22 to enable the desired oven temperature to be selected by the user of the oven 12. Disposed within a cavity 24 of the oven 12 are a conventional broiling element 26 and a conventional heating element 28. Finally, suitably positioned within the cavity 24 of the oven 12 is a conventional temperature sensor 30, for example, a standard oven temperature sensing probe.

The digital electronic control system 14 includes a conventional microprocessor 32 capable of being suitably programmed to effect the desired control of the range 10 and, more particularly with respect to the present invention, the oven 12. Conventionally, the microprocessor 32 includes an analog-to-digital (A/D) converter 34 for receiving analog voltage input signals from, for example, the temperature sensor 30 and for providing digital output pulses or signals to a controller section 36 within the microprocessor 32. Conventionally, the microprocessor 32 includes a memory 38 for retaining the programmed instructions for operating the control system 14 including a desired oven temperature control algorithm for controlling the temperature of the oven 12.

The control system 14 further includes an offset signal circuit 40 for providing a desired temperature offset signal to the controller 36 of the microprocessor 32 during a recalibration operation. For example, the offset signal circuit 40 conventionally could take the form of three digital input signals to the controller 36. The three digital input signals may be used to enable a recalibration of the bake temperature in three 7° F. steps for a maximum bake temperature offset during recalibration of ±21° F. Specifically, a first one of the three digital input signals may be used to indicate a desired positive bake temperature offset when, for example, that input signal is low and a desired negative bake temperature offset when, for example, that digital input signal is high. A second one of the three digital input signals may be used to indicate an offset of the bake temperatures of 7° F. when, for example, that input signal is high; and the third input signal may be used to indicate a desired bake temperature offset of 14° F. when, for example, that input signal is high.

The control system 14 also includes a power switching relay 42 that includes a pair of relay contacts 44 and 46 for switching power to the heating element 28 from a constant voltage (e.g., 240 volts) source 48 of alternating current electric power, under the control of the controller 36. For simplification, only the heating element 28 and the power relay 42 therefor have been illustrated in FIG. 2 in the control system 14. In an actual commercial embodiment, however, the broiling element 26 would obviously also be part of the control system 14 along with its own power switching relay to interconnect the broiling element 26 to the source 48 under the control of the controller 36. The broiling element 26 would obviously be used in conjunction with the heating element 28 during the BROIL mode of operation of the oven 12 and may also be used during the CLEAN and BAKE modes of operation of the oven 12 to provide sufficient heat to the oven 12 under the control of the controller 36.

During the BAKE mode of operation, the heating element 28 is energized by the source 48 through the relay 42 under the control of the controller 36 to heat and raise the temperature of items to be cooked within the oven cavity 24 of the oven 12. The sensor 30, typically disposed within the oven cavity 24, is used to provide an output analog voltage signal as an input to the A/D converter 34. That analog input signal is converted to a digital output signal and is supplied to the memory 38 and the controller 36 for controlling the ON-OFF state of the relay 42 and, thereby, the energization of the heating element 28.

As is conventional, a user of the range 10 selects by means of the control knob 20 the desired mode of operation of the oven 12, which mode selection is provided as an input signal to the microprocessor 32 by a conventional mode selection circuit **20*c*. If the BAKE mode of operation of the oven 12 has been selected, the user also selects a desired bake temperature by means of the control knob 22, which desired temperature is also provided as an input signal to the microprocessor 32 by a conventional desired temperature circuit 22*c*. The microprocessor 32 then, through the controller 36, controls the state of the power relay 42 to energize or deenergize the heating element 28 as a function of the actual oven temperature as sensed by the sensor 30 and of the desired temperature as provided by the desired temperature circuit 22*c*. The broiling element 26** may be similarly controlled to provide additional heat during the BAKE mode.

As a result of a recalibration operation, one or the other of the above temperature signals may be modified by a temperature offset signal from the offset signal circuit 40, the adjusted temperature signal being compared to the other temperature signal by a conventional preprogrammed temperature control algorithm to control, through the controller 36, the duty cycle of the heating element 28, that is, the percentage of time that the heating element 28 is ON or energized during a particular oven operation.

During the BROIL mode of operation, the broiling element 26 is energized or deenergized through an associated power relay under the control of the controller 36 of the microprocessor 32. If the CLEAN mode of operation is selected, the energization of one or both of the oven heating elements 26 and 28 occurs under the control of the microprocessor 32 to maintain the temperature of the oven 12 at a relatively high level, for example, 870° F. As depicted in simplified form in FIG. 3, during a "Nominal Cleaning Cycle", the heating elements 26, 28, assuming both are used, are cycled ON and OFF under the control of the microprocessor 32 to maintain the temperature of the oven 12, as detected by the sensor 30, at the relatively high clean temperature.

A prior art commercial embodiment of the range 10 manufactured and sold by the assignee of the present invention uses an A/D converter 34 having a relatively broad output temperature signal resolution in the CLEAN mode as compared to its resolution in the BAKE mode, the output signal of the A/D converter 34 being incremented in the CLEAN mode one count only after the oven cavity 24 has changed temperature by more than, for example, 10° F. Temperature differences in the CLEAN mode less than that amount (10° F.) could not be read by that conventional closed-loop control system, which operated essentially the same as the description heretofore of the control system 14.

The duty cycle of the heating elements 26, 28 controlled by the control system 14 acting in a conventional or nominal closed-loop manner is depicted in simplified form in the waveform in FIG. 3 labeled "Nominal Cleaning Cycle". As would be understood by those of ordinary skill in this art, the waveforms shown in FIG. 3 may represent directly the ON and OFF states of the heating elements 26, 28 or may represent the envelope of heating element activation within which the actual ON and OFF states of the heating elements 26, 28 may vary according to a preprogrammed timed duty cycling scheme. In the latter case, a FIG. 3 waveform high level indicates that timed duty cycling is occurring, while a low level indicates that the heating elements 26, 28 are not cycling, i.e., are in the OFF state, and hence are not providing heat to the oven cavity 24.

As depicted in the above-mentioned waveform, the heating elements 26, 28 are maintained energized or ON until the microprocessor 32 determines from the sensor 30 that the temperature of the oven cavity 24 has exceeded the preprogrammed, clean temperature of, for example, 870° F. Upon reaching that temperature, as sensed by the sensor 30, the microprocessor 32 through the controller 36 deenergizes the heating elements 26, 28 by switching OFF the power relay 42 and the power relay associated with the broiling element 26. As depicted in FIG. 3, the heating elements 26, 28 are maintained OFF until the output signal of the A/D converter 34 decrements one count in response to the temperature of the oven cavity 24 falling below the preprogrammed clean temperature.

While the closed-loop temperature control system discussed heretofore has been found to be effective in commercial prior art ranges, it would be desirable to control the clean temperature of self-cleaning ovens more accurately because too high a clean temperature may result in excessive oven or range surface temperatures, a safety concern, while too low a clean temperature may not clean the oven cavity 24 effectively. Therefore, a need exists to enable the clean temperature to be changed when the bake temperatures of the oven 12 are recalibrated to account for degradation or variation in the operation of or the sensitivity of one or more oven components, for example, the sensor 30, while limiting the change to the clean temperature to a value smaller than that capable of being detected by the control system 14 operating in a closed-loop manner.

In accordance with an important feature of the present invention, upon recalibration of the bake temperatures of the oven 12, the control system 14 adjusts the duty cycle of the heating elements 26, 28 in accordance with the nature of the recalibration, enabling the control system 14 to operate in an open-loop manner during the self-cleaning mode of operation of the oven 12. Specifically, upon recalibration, the microprocessor 32 adjusts the duty cycle of the heating elements 26, 28 involved in heatin the oven cavity 24 in the CLEAN mode of operation in accordance with the middle and lower waveforms of FIG. 3 respectively labeled "Hi-Temp Recalibrated Clean Cycle" and "Lo-Temp Recalibrated Clean Cycle". More particularly, prior to open-loop operation, the microprocessor 32 measures and stores in the memory 38 a predetermined number of the values of the ON times and intervening OFF times of the heating elements 26, 28 utilized in a nonrecalibrated self-cleaning operation. After measuring a predetermined successive number of such cycle times, an average value of the duty cycle, i.e., a percentage, is determined. Such an average value may be continuously updated, prior to recalibration of the bake temperatures, by storing an immediately preceding predetermined number of such ON and intervening OFF values, the average values of which are continuously updated and the resultant average duty cycle stored by the microprocessor 32 in a non-volatile portion of the memory 38 which retains such ON and OFF average values should power to the microprocessor 32 be discontinued. Thereafter, upon recalibration of the bake temperatures of the oven 12, the duty cycle is adjusted. The use of non-volatile memory may be precluded by determining such ON and OFF values at the beginning of each CLEAN mode. In such a case, nonrecalibrated closed-loop operation is maintained only until a predetermined number of ON and OFF values have been compiled. Open-loop operation is then initiated to alter the average value of the temperature of the oven cavity 24 during the CLEAN mode of operation. Specifically, after recalibration, the controller 36 detects the temperature offset signal from the offset signal circuit 40. If the temperature offset signal is positive, representative, for example, of an increase in the baking temperatures of +7° F. or +14° F. or +21° F., then the duty cycle of the heating elements 26, 28 (and of their associated power relays) is increased slightly by an empirically determined amount as depicted in the curve of FIG. 3 labeled "Hi-Temp Recalibrated Clean Cycle". Such an increase preferably is determined empirically because most different models of electric ranges have their own individual temperature characteristics due to the use of different insulation systems, different oven cavity 24 configurations, different heating elements 26, 28 and different sensors 30. Because the temperature of the oven cavity 24 is directly related to the product of the power provided by the heating elements 26, 28 and their duty cycle, slightly increasing the duty cycle of the heating elements 26, 28 during the CLEAN mode of operation results in an increase in the average temperature of the oven cavity 24 during a self-cleaning operation. Preferably, for safety reasons, such an increase in the average temperature would be limited to a value less than that detectable by the closed-loop operation of the control system 14, i.e., in the above example, less than 10° F., the resolution of the A/D converter 34 in the CLEAN mode of operation. Such an average temperature increase enables the control system 14 to operate in an open-loop manner to account for variations in the operation of one or more oven components, for example, the temperature sensor 30, while limiting the increase in the self-cleaning temperature to a value smaller than that capable of being detected by the closed-loop operation of the control system 14.

Correspondingly, if an offset temperature signal from the offset signal circuit 40 is negative, representative, for example, of a decrease in the nominal values of the bake temperatures of −7° F. or −14° F. or −21° F., then the duty cycle of the heating elements 26, 28 and of their associated power relays is decreased by a second empirically determined amount thereby decreasing the average temperature of the oven cavity 24 during a self-cleaning operation. The decrease in the duty cycle of the heating elements 26, 28 is illustrated in the curve of FIG. 3 labeled "Lo-Temp Recalibrated Clean Cycle". In order not to seriously affect the self-cleaning performance of the oven 12, the decrease in the average temperature preferably is also limited to a value less than that capable of being detected by the closed-loop operation of the control system 14. In the above example, such a temperature decrease would therefore be less than 10° F. In any event, the output signal from the sensor 30 as provided to the A/D converter 34 is continuously monitored by the microprocessor 32 to ensure that the nominal, closed-loop reference self-cleaning temperature is not departed from by more than the open-loop clean temperature offset value obtained by increasing or decreasing the duty cycle of the heating elements 26, 28 as discussed hereinabove.

In this manner, the self-cleaning temperature of the oven 12 may be changed in accordance with a recalibration of the bake temperatures to account for variations in the operation of one or more oven components, for example, the sensor 30, while limiting for safety and performance reasons, any such change to values smaller than those capable of being detected by the nominal closed-loop operation of the control system 14.

Obviously, many modifications and variations of the present invention are possible in light of the above teachings. While for the sake of simplicity, the controls 16, 20 and 22 are depicted in FIG. 1 as rotatable control knobs, those controls may obviously assume other conventional forms, such as touch sensitive electronic switches or switch panels. Thus, it is to be understood that, within the scope of the appended claims, the invention may be practiced otherwise than as specifically described hereinabove.

What is claimed and desired to be secured by Letters Patent is:

1. A self-cleaning oven comprising an oven cavity adapted to receive items to be cooked by said oven, heating means within said oven for raising the temperature of said oven cavity and control means for controlling the operation of said oven, said oven being controllably operable in a closed-loop manner in a BAKE mode of operation to establish and maintain a desired bake temperature in said oven cavity from a range of bake temperatures and being controllably operable in a closed-loop manner in a separate CLEAN mode of operation to establish and maintain a self-cleaning temperature in said oven cavity, said control means including automated means for controlling the duty cycle of said heating means during a CLEAN mode of operation and recalibration means for selectively increasing or decreasing the nominal values of said bake temperatures, said automated means being operable in an open-loop manner during said CLEAN mode of operation upon recalibration of said oven by said recalibration means to adjust the average value of said self-cleaning temperature by an amount less than that capable of being detected by said automated means operating in said closed-loop manner.

2. A self-cleaning oven as recited in claim 1 wherein said automated means comprises a microprocessor.

3. A self-cleaning oven as recited in claim 1 wherein said automated means includes a memory, an analog-to-digital converter and a controller.

4. A self-cleaning oven as recited in claim 3 wherein said control means further includes oven temperature sensing means for detecting the temperature in said oven cavity, said oven temperature sensing means providing an analog voltage output signal to the input of said converter for enabling said controller to control said duty cycle of said heating means during said CLEAN mode of operation.

5. A self-cleaning oven as recited in claim 4 wherein, upon an increase in said nominal values of said bake temperatures by said recalibration means, said automated means is operable to increase said duty cycle of said heating means during said CLEAN mode of operation.

6. A self-cleaning oven as recited in claim 5 wherein, upon a decrease in said nominal values of said bake temperatures by said recalibration means, said automated means is operable to decrease said duty cycle of said heating means during said CLEAN mode of operation.

7. A self-cleaning oven as recited in claim 4 wherein said control means further includes a power relay for energizing said heating means, said relay being under the control of said controller.

8. A self-cleaning oven comprising:

heating means for raising the temperature of said oven, automated means for controlling the operation of said oven in a BAKE mode of operation and in a CLEAN mode of operation and recalibration means for selectively changing the nominal values of the bake temperatures of said oven during said BAKE mode of operation, said automated means being operable upon recalibration of said oven by said recalibration means to adjust the average value of the self-cleaning temperature of said oven during said CLEAN mode of operation, said automated means being operable in a closedloop manner to control the operation of said oven in said BAKE mode of operation and in said CLEAN mode of operation, the adjustment of said average value of said self-cleaning temperature during said CLEAN mode of operation upon recalibration of said oven being of an amount less than that capable of being detected by said automated means operating in said closed-loop manner.

9. A self-cleaning oven as recited in claim 8 further including means for sensing the internal temperature of said oven during said BAKE mode of operation and during said CLEAN mode of operation.

10. A self-cleaning oven as recited in claim 9 wherein said automated means includes a microprocessor memory, an analog-to-digital converter and a microprocessor controller.

11. A self-cleaning oven as recited in claim 10 wherein said sensing means provides an analog voltage output signal to said converter for enabling said controller to control the duty cycle of said heating means in a closed-loop manner at least partially in response to said analog voltage output signal from said sensing means.

12. A self-cleaning oven as recited in claim 8 wherein said automated means is operable to increase said average value of said self-cleaning temperature upon an increase of said nominal values of said bake temperatures by said recalibration means.

13. A self-cleaning oven as recited in claim 8 wherein said automated means is operable to decrease said average value of said self-cleaning temperature upon a decrease of said nominal values of said bake temperatures by said recalibration means.

14. A method for controlling the operation of a self-cleaning oven of the type having an oven cavity and heating means within the oven cavity for raising the temperature of the oven cavity and control means for automatically controlling the operation of said oven in a BAKE mode of operation and in a separate CLEAN mode of operation and recalibration means for selectively increasing or decreasing the nominal values of the bake temperatures of the oven upon recalibration of the oven, said method comprising the steps of sensing the temperature of said oven cavity during said CLEAN mode of operation, controlling the operation of said oven during said CLEAN mode of operation in a closed-loop manner to ensure that a self-cleaning temperature range is not exceeded and upon recalibration, adjusting the self-cleaning temperature of said oven in an open-loop manner in accordance with the nature of the recalibration of said oven.

15. A method for controlling the operation of a self-cleaning oven as recited in claim 14 wherein said adjusting step includes the step of adjusting the duty cycle of said heating means upon and in accordance with the nature of said recalibration.

16. A method for controlling the operation of a self-cleaning oven as recited in claim 15 wherein said duty cycle adjusting step comprises the step of increasing the duty cycle of said heating means upon an increase in said nominal values of said bake temperatures during said recalibration step.

17. A method for controlling the operation of a self-cleaning oven as recited in claim 16 wherein said duty cycle adjusting step comprises the step of decreasing the duty cycle of said heating means upon a decrease in said nominal values of said bake temperature during said recalibration step.

* * * * *